US011124885B2

(12) United States Patent
Xu et al.

(10) Patent No.: US 11,124,885 B2
(45) Date of Patent: Sep. 21, 2021

(54) ANODE CATALYST SUITABLE FOR USE IN AN ELECTROLYZER

(71) Applicant: GINER, INC., Newton, MA (US)

(72) Inventors: Hui Xu, Acton, MA (US); Cortney Mittelsteadt, Wayland, MA (US); Brian Rasimick, Boston, MA (US); Allison Stocks, Somerville, MA (US)

(73) Assignee: PLUG POWER INC., Latham, NY (US)

( * ) Notice: Subject to any disclaimer, the term of this patent is extended or adjusted under 35 U.S.C. 154(b) by 0 days.

(21) Appl. No.: 14/742,422

(22) Filed: Jun. 17, 2015

(65) Prior Publication Data

US 2015/0368817 A1 Dec. 24, 2015

Related U.S. Application Data

(60) Provisional application No. 62/013,232, filed on Jun. 17, 2014.

(51) Int. Cl.

| | |
|---|---|
| ***C25B 9/23*** | (2021.01) |
| ***C25B 9/40*** | (2021.01) |
| ***C25B 9/65*** | (2021.01) |
| ***C25B 11/067*** | (2021.01) |
| ***C25B 11/077*** | (2021.01) |

(52) U.S. Cl.

CPC ..... *C25B 9/23* (2021.01); *C25B 9/40* (2021.01); *C25B 9/65* (2021.01); *C25B 11/067* (2021.01); *C25B 11/077* (2021.01)

(58) Field of Classification Search

CPC .... C25B 1/04; C25B 1/10; C25B 9/08; C25B 9/10; C25B 9/16; C25B 11/00–11/097; C25B 9/23; C25B 9/40; C25B 9/65; B01J 23/42; B01J 23/46; B01J 23/462; B01J 23/468

See application file for complete search history.

(56) References Cited

U.S. PATENT DOCUMENTS 4,992,406 A * 2/1991 Mauldin ..... B01J 21/06 502/304

7,976,989 B2 7/2011 Lopez et al.

(Continued)

OTHER PUBLICATIONS

Gojkovic et al (Journal of Electroanalytical Chemistry, vol. 639, Issues 1-2, Feb. 15, 2010, pp. 161-166).*

(Continued)

*Primary Examiner* — Alexander W Keeling

(74) *Attorney, Agent, or Firm* — Heslin Rothenberg Farley & Mesiti P.C.; Victor A. Cardona, Esq.

(57) ABSTRACT

An anode catalyst suitable for use in an electrolyzer. The anode catalyst includes a support and a plurality of catalyst particles disposed on the support. The support may include a plurality of metal oxide or doped metal oxide particles. The catalyst particles, which may be iridium, iridium oxide, ruthenium, ruthenium oxide, platinum, and/or platinum black particles, may be arranged to form one or more aggregations of catalyst particles on the support. Each of the aggregations of catalyst particles may include at least 10 particles, wherein each of the at least 10 particles is in physical contact with at least one other particle. The support particles and their associated catalyst particles may be dispersed in a binder.

17 Claims, 5 Drawing Sheets

(56) References Cited

U.S. PATENT DOCUMENTS

| | | | | |
|---|---|---|---|---|
| 2005/0084739 | A1* | 4/2005 | Swider-Lyons ..... | H01M 4/8605 429/419 |
| 2011/0048962 | A1* | 3/2011 | Reece ..... | C25B 1/04 205/633 |
| 2012/0122019 | A1 | 5/2012 | DiSalvo, Jr. et al. | |
| 2014/0305805 | A1* | 10/2014 | Vajda ..... | C25B 11/02 205/462 |
| 2014/0322631 | A1 | 10/2014 | Klose-Schubert et al. | |
| 2015/0349368 | A1* | 12/2015 | Arges ..... | H01M 8/186 429/422 |

OTHER PUBLICATIONS

Hu et al (International Journal of Hydrogen Energy,"IrO2/-Nb—TiO2 electrocatalyst for oxygen evolution reaction in acidic medium",39 , Mar. 2014, pp. 6967-6976) (Year: 2014).*

Puthiyapura et al (International Journal of Hydrogen Energy, "Investigation of supported IrO2 as electrocatalyst for the oxygen evolution reaction in proton exchange membrane water electrolyser", vol. 39, issue 5, Feb. 2014, pp. 1905-1913) (Year: 2014).*

Aryanpour et al (Chemistry of Materials, "Tungsten-Doped Titanium Dioxide in the Rutile Structure: Theoretical Considerations", vol. 21, issue 8, 2009, pp. 1627-1635) (Year: 2009).*

Web Elements ("Iridium", 2008) (Year: 2008).*

Petkovik et al "Pt/TiO2 (rutile) catalysts for sulfuric acid decomposition in sulfur-based thermochemical water-splitting cycles", Applied Catalysis A: General Volume, 338, Issues 1-2, Apr. 1, 2008, pp. 27-36). (Year: 2008).*

Gupta et al ("A review of TiO2 nanoparticles", Chinese Science Bulletin, vol. 56, vol. 16, 2011, pp. 1639-1657) (Year: 2011).*

Kong et al. ("Electrohemical studies of Pt/IrelrO2electrocatalyst as a bifunctional oxygen electrode", International Journal of Hydrogen Energy, 37, 2012, pp. 59-67) (Year: 2012).*

Subban et al ("Sol-Gel Synthesis, Electrochemical Characterization, and Stability Testing of Ti0.7W0.3O2 Nanoparticles for Catalyst Support Applications in Proton-Exchange Membrane Fuel Cells", Journal of the American Chemical Society, 132, 39, 2010, pp. 17531-17536). (Year: 2010).*

Aizawa et al ("Deposition dynamics and chemical properties of size-selected Ir clusters on TiO2", Surface Science, 542, 2003, pp. 253-275) (Year: 2003).*

Kaden et al (Cluster size effects on sintering, CO adsorption, and implantation in Ir/SiO2, The Journal of Chemical Physics, 131, 2009, pp. 114701-1-114701-15). (Year: 2009).*

Mayousse et al., "Synthesis and characterization of electrocatalysts for the oxygen evolution in PEM water electrolysis," International Journal of Hydrogen Energy, 36:10474-10481 (2011).

Kinoshita, "Small-Particle Effects and Structural Considerations for Electrocatalysis," Modern Aspects of Electrochemistry, 557-637, Plenum Press, New York, NY (1982).

Shao et al., "Electrocatalysis on Platinum Nanoparticles: Particle Size Effect on Oxygen Reduction Reaction Activity," Nano Lett., 11:3714-3719 (2011).

Reier et al., "Electrocatalytic Oxygen Evolution Reaction (OER) on Ru, Ir, and Pt Catalysts: A Comparative Study of Nanoparticles and Bulk Materials," ACS Catalysis, 2:1765-1772 (2012).

* cited by examiner

ANODE CATALYST SUITABLE FOR USE IN AN ELECTROLYZER

CROSS-REFERENCE TO RELATED APPLICATIONS

The present application claims the benefit under 35 U.S.C. 119(e) of U.S. Provisional Patent Application No. 62/013,232, inventors Hui Xu et al., filed Jun. 17, 2014, the disclosure of which is incorporated herein by reference.

FEDERALLY SPONSORED RESEARCH OR DEVELOPMENT

This invention was made with government support under DOE SBIR Phase II and Phase JIB Grant No. DE-SC0007471 entitled "High-Performance, Long-Lifetime Catalysts for Proton Exchange Membrane Electrolysis" awarded by the United States Department of Energy. The government has certain rights in the invention.

BACKGROUND OF THE INVENTION

The present invention relates generally to anode catalysts of the type that are suitable for use in an electrolyzer and relates more particularly to a novel such anode catalyst.

Standard water electrolysis generates hydrogen and oxygen gases by applying a direct current in order to dissociate the water reactant. Alkaline and proton exchange membrane (PEM) electrolyzers are two major types of electrolyzer used for water electrolysis. PEM electrolysis is a particularly attractive method due to the lack of corrosive electrolytes, a small footprint, and the requirement of only deionized water as a reactant. PEM electrolysis also produces very pure hydrogen without the typical catalyst poisons that may be found in hydrogen produced from reformation. Despite these advantages of PEM electrolysis, current hydrogen production from PEM electrolysis only comprises a small fraction of the global hydrogen market, primarily due to its high cost of expensive components (e.g., membranes, catalysts, and bipolar plates) and the electricity consumption.

One of the main obstacles in manufacturing an efficient PEM electrolyzer is the anode over-potential. The anode over-potential results from the poor oxygen evolution reaction (OER) kinetics. Ways to lower the over-potential at the anode are to utilize a better catalyst, increase the catalyst amount, or operate at higher temperature. One of the active catalysts identified for the oxygen evolution reactions is iridium oxide ($IrO_2$). State-of-the-art $IrO_2$ anode catalyst used for PEM electrolysis uses large particle sizes, generally varying from 20 nm to 100 nm since these particles are not dispersed on any support (see, for example, Mayousse et al., "Synthesis and characterization of electrocatalysts for the oxygen evolution in PEM water electrolysis," *International Journal of Hydrogen Energy,* 36:10474-10481 (2011), which is incorporated herein by reference).

Studies of the oxygen reduction reaction on platinum surface show that the mass activity of platinum catalyst could be significantly improved by reducing the catalyst particle size to a nano-sized level (<2 nm), which is associated with the oxygen binding energies on different platinum sites accessible on cuboctahedral particles of various sizes (see, for example, Kinoshita 1982, "Small-Particle Effects and Structural Considerations for Electrocatalysis", *Modern Aspects of Electrochemistry,* 557-637, Plenum Press, New York, N.Y. (1982); and Shao et al., "Electrocatalysis on Platinum Nanoparticles: Particle Size Effect on Oxygen Reduction Reaction Activity," *Nano Lett.,* 11:3714-3719 (2011), both of which are incorporated herein by reference). The advance of PEM fuel cell technology has enabled the deposition of platinum nanoparticles on high surface area carbon black, thus increasing the available electrochemical surface area (ECA) from 20 $m^2/g$ to >100 $m^2/g$. As a result in this increase in ECA, the amount of platinum required for the oxygen reduction reaction (ORR) becomes greatly reduced. In addition, the introduction of carbon supports has provided porous electrodes that are beneficial for fuel cell transport properties. Unfortunately, since PEM electrolyzers operate at high voltages (>1.5 V), conventional carbon supports undergo fast electrochemical oxidation (or carbon corrosion), which leads to significant carbon loss.

SUMMARY OF THE INVENTION

It is an object of the present invention to provide a new anode catalyst.

According to one feature of the invention, an anode catalyst is provided, the anode catalyst comprising (a) a support; and (b) a plurality of catalyst particles disposed on the support, the catalyst particles being arranged to form one or more aggregations of catalyst particles, wherein each of the aggregations of catalyst particles comprises at least 10 particles and wherein each of the at least 10 particles is in physical contact with at least one other particle.

In another, more detailed feature of the invention, the support may comprise at least one particle.

In another, more detailed feature of the invention, the support may comprise a plurality of particles.

In another, more detailed feature of the invention, the support may comprise particles having a diameter in the range of about 5 nanometers to about 2 microns.

In another, more detailed feature of the invention, the support may comprise at least one of a metal oxide and a doped metal oxide.

In another, more detailed feature of the invention, the metal oxide may be at least one member selected from the group consisting of titanium oxide, zirconium oxide, niobium oxide, tantalum oxide, and tin oxide.

In another, more detailed feature of the invention, the doped metal oxide may comprise a dopant that may be at least one member selected from the group consisting of tungsten, molybdenum, niobium, and fluorine.

In another, more detailed feature of the invention, the dopant may constitute about 1-30% by weight of the doped metal oxide.

In another, more detailed feature of the invention, the catalyst particles may comprise at least one member selected from the group consisting of iridium, iridium oxide, ruthenium, ruthenium oxide, platinum, and platinum black particles.

In another, more detailed feature of the invention, the catalyst particles may have a diameter in the range of about 0.5-5.0 nanometers.

In another, more detailed feature of the invention, the support may be a particle and the catalyst particles may cover at least 20% of the circumference of the support.

In another, more detailed feature of the invention, the support may have an open surface area in the range of about 20-80%.

In another, more detailed feature of the invention, the support may comprise a plurality of support particles, and the anode catalyst may further comprise a binder, the support particles being dispersed in the binder.

According to another aspect of the invention, there is provided an electrolyzer cell, the electrolyzer cell comprising (a) a solid polymer proton exchange membrane, the solid polymer proton exchange membrane having first and second opposed faces; (b) an anode catalyst layer, the anode catalyst layer being positioned along the first face of the solid polymer proton exchange membrane, said anode catalyst layer comprising a support and a plurality of catalyst particles disposed on the support, the catalyst particles being arranged to form one or more aggregations of catalyst particles, wherein each of the aggregations of catalyst particles comprises at least 10 particles and wherein each of the at least 10 particles is in physical contact with at least one other particle; (c) a cathode catalyst layer, the cathode catalyst layer being positioned along the second face of the solid polymer proton exchange membrane; (d) a first current collector, the first current collector being positioned along the anode catalyst layer opposite the solid polymer exchange membrane; and (e) a second current collector, the second current collector being positioned along the cathode catalyst layer opposite the solid polymer exchange membrane.

In another, more detailed feature of the invention, the support may comprise a plurality of particles having a diameter in the range of about 5 nanometers to about 2 microns.

In another, more detailed feature of the invention, the support may comprise at least one of a metal oxide and a doped metal oxide.

In another, more detailed feature of the invention, the metal oxide may be at least one member selected from the group consisting of titanium oxide, zirconium oxide, niobium oxide, tantalum oxide, and tin oxide.

In another, more detailed feature of the invention, the doped metal oxide may comprise a dopant that may be at least one member selected from the group consisting of tungsten, molybdenum, niobium, and fluorine.

In another, more detailed feature of the invention, the catalyst particles may comprise at least one member selected from the group consisting of iridium, iridium oxide, ruthenium, ruthenium oxide, platinum, and platinum black particles.

In another, more detailed feature of the invention, the catalyst particles may have a diameter in the range of about 0.5-5.0 nanometers.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF THE INVENTION

The present invention is based, at least in part, on the discovery of a novel anode catalyst. The anode catalyst of the present invention is particularly well-suited for use in, but is not limited to use in, electrolyzers, such as, but not limited to, PEM-based water electrolyzers. The novel anode catalyst of the present invention overcomes the disadvantages of carbon black supports and achieves a lower overpotential for water electrolysis.

More specifically, according to one aspect of the invention, the anode catalyst of the present invention may comprise a support and a plurality of catalyst particles disposed on the support, the catalyst particles being arranged to form one or more aggregations of catalyst particles.

In a preferred embodiment, the support may be in the form of one or more particles. The one or more support particles may each have a diameter in the range of about 5 nanometers to about 2 microns. The one or more support particles may each comprise a metal oxide or a doped metal oxide. Examples of the metal oxide may include one or more members selected from the group consisting of titanium oxide, zirconium oxide, niobium oxide, tantalum oxide, and tin oxide. Examples of the dopant may include one or more members selected from the group consisting of tungsten, molybdenum, niobium, and fluorine. A preferred range for the amount of dopant in the doped metal oxide may be about 1-30% by weight.

In a preferred embodiment, the catalyst particles may be one or more members selected from the group consisting of iridium, iridium oxide, ruthenium, ruthenium oxide, platinum, and platinum black particles. The catalyst particles may have a diameter in the range of about 0.5-5.0 nanometers.

In a preferred embodiment, the catalyst particles may comprise one or more aggregations of at least 10 particles, wherein each particle is in physical contact with at least one other particle. The aggregation may be in the form of, for example, a branched or unbranched chain and/or a cluster. Where the support is a particle, the catalyst particles may cover at least 20% of the circumference of the support. In a preferred embodiment, the support may have an open (i.e., uncovered) surface area in the range of about 20-80%, preferably about 50-70%.

Figure 1:
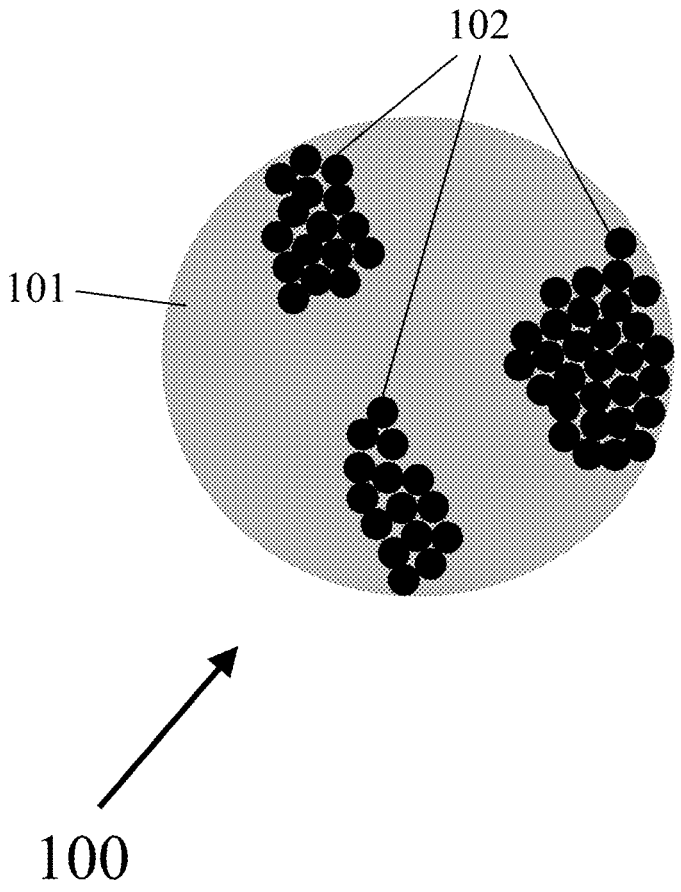
FIG. 1 is a schematic front view of one embodiment of an anode catalyst according to the teachings of the present invention.

Referring now to FIG. 1, there is schematically shown an embodiment of an anode catalyst constructed according to the teachings of the present invention, the anode catalyst being represented generally by reference numeral 100.

Anode catalyst 100 may comprise a support 101. In the present embodiment, support 101 may be in the form of a particle; however, it is to be understood that support 101 need not be limited to particle form. Support 101 may have a diameter in the range of about 5 nanometers to about 2 microns and may comprise a metal oxide of the type described above, such as titanium oxide, zirconium oxide, niobium oxide, tantalum oxide, and tin oxide, or may comprise a doped metal oxide including a dopant of the type described above, such as tungsten, molybdenum, niobium, and fluorine.

Anode catalyst 100 may further comprise one or more catalyst particles 102. Catalyst particles 102, each of which may have a diameter of about 0.5 to 5.0 nanometers, may be arranged in one or more aggregations, which may be in the form of one or more of an unbranched chain, a branched chain, and a cluster. Preferably, each aggregation of catalyst particles 102 may comprise at least ten catalyst particles 102, wherein each catalyst particle 102 is in physical contact with at least one other catalyst particle 102. Catalyst particles 102 may comprise a material of the type described above, such as iridium, iridium oxide, ruthenium, ruthenium oxide, platinum, and platinum black. The one or more aggregations of catalyst particles 102 may cover at least 20% of the circumference of support 101. The open surface area (i.e. the surface of support 101 not covered by aggregated catalyst particles 102) may be in the range of about 20-80% with a preferred range of about 50-70%.

In order to achieve one or more aggregations of catalyst particles 102 on the surface of support 101, catalyst particles 102 may be deposited by electroless plating. Using the electroless plating method, particles of support 101 may be dispersed into a reaction solvent. A catalyst precursor (e.g. iridium trichloride for iridium oxide catalyst particles) may then be dissolved into the reaction solvent, and a reducing agent, such as ethylene glycol, borohydride, or hydrazine may be added. The catalyst precursor may thereby be reduced to form the catalyst particles. Using controlled heating in the range of about −50° C. to about 250° C. (depending on the reaction solvent) and controlled stirring rate in the range of about 1 rpm to about 180 rpm (depending on the size of the stir bar and the volume and shape of the container in which the solution is stirred), an aggregation of catalyst particles may be deposited on the surface of the support particle as the catalyst precursor is reduced.

The anode catalyst of the present invention may further comprise a binder in which a plurality of support particles, together with their associated catalyst particles, may be dispersed. Examples of the binder may include ionomers, such as Nafion®, Aquivion®, FumaPEM®, and sulfonated hydrocarbons.

Figure 2:
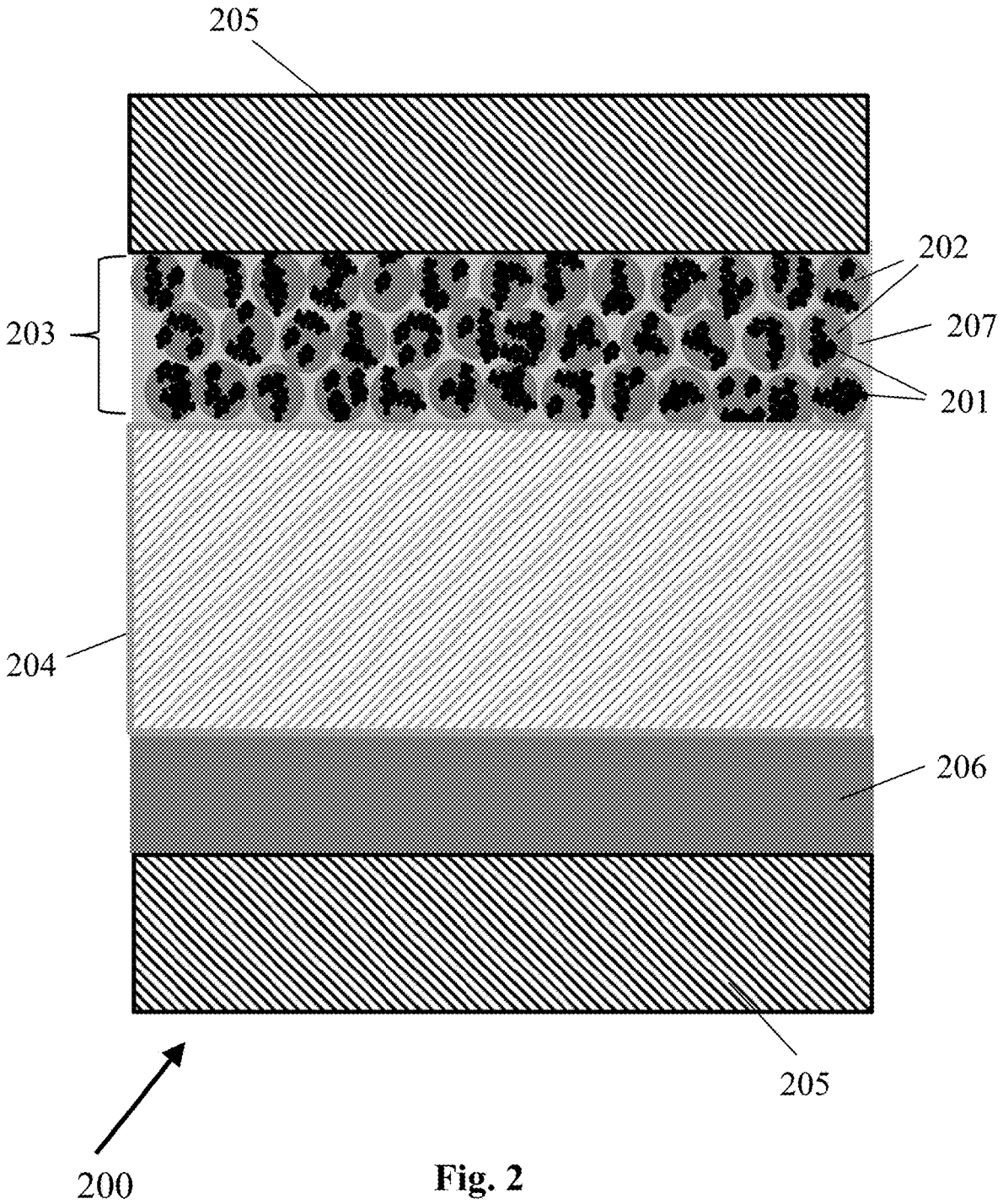
FIG. 2 is a schematic section view of one embodiment of a PEM-based water electrolyzer cell including the anode catalyst of FIG. 1.

Referring now to FIG. 2, there is schematically shown an embodiment of PEM-based water electrolyzer cell that includes the above-described anode catalyst, the PEM-based water electrolyzer cell being represented generally by reference numeral 200.

PEM-based water electrolyzer cell 200 may comprise a PEM 204, an anode catalyst layer 203, a cathode catalyst layer 206, and current collectors 205. PEM 204 may be a solid polymer proton-exchange membrane that provides ionic conductivity between the cathode and anode catalyst layers. Examples of materials suitable for use as PEM 204 include, but are not limited to, Nafion®, Aquivion®, FumaPEM®, and sulfonated hydrocarbons. Anode catalyst layer 203 and cathode catalyst layer 205 may be deposited on PEM 204 by wet-casting, dry-casting, hot-pressing, or directly spraying the respective catalyst layers onto PEM 204. Cathode catalyst layer 206 may comprise standard cathode catalysts, such as platinum on carbon. Anode catalyst layer 203 may comprise a plurality of support particles 202, each of which carries one or more aggregations of catalyst particles 201. Support particles 202 may be similar or identical to support 101, and catalyst particles 201 may be similar or identical to catalyst particles 102. Catalyst particles 201 may be deposited on support 202 by a method that is similar or identical to the above-described method for depositing catalyst particles 102 onto catalyst support particles 101. Support particles 202, together with their associated catalyst particles 201, may be dispersed in a binder 207, which may be, for example, an ionomer of the type described above. After cathode catalyst layer 206 and anode catalyst layer 204 have been deposited on the PEM, current collectors 205 may be mechanically-secured against cathode catalyst layer 206 and anode catalyst layer 204 on the sides opposite PEM 204. Current collectors 205 supply the voltage to the PEM-based water electrolyzer cell via an externally connected circuit wherein PEM-based water electrolyzer cell operates in the preferred range of 1.6V-2.0V.

The following examples are provided for illustrative purposes only and are in no way intended to limit the scope of the present invention:

EXAMPLE 1

Uniform Dispersion of Catalyst Particles on Catalyst Support Particles

Figure 3:
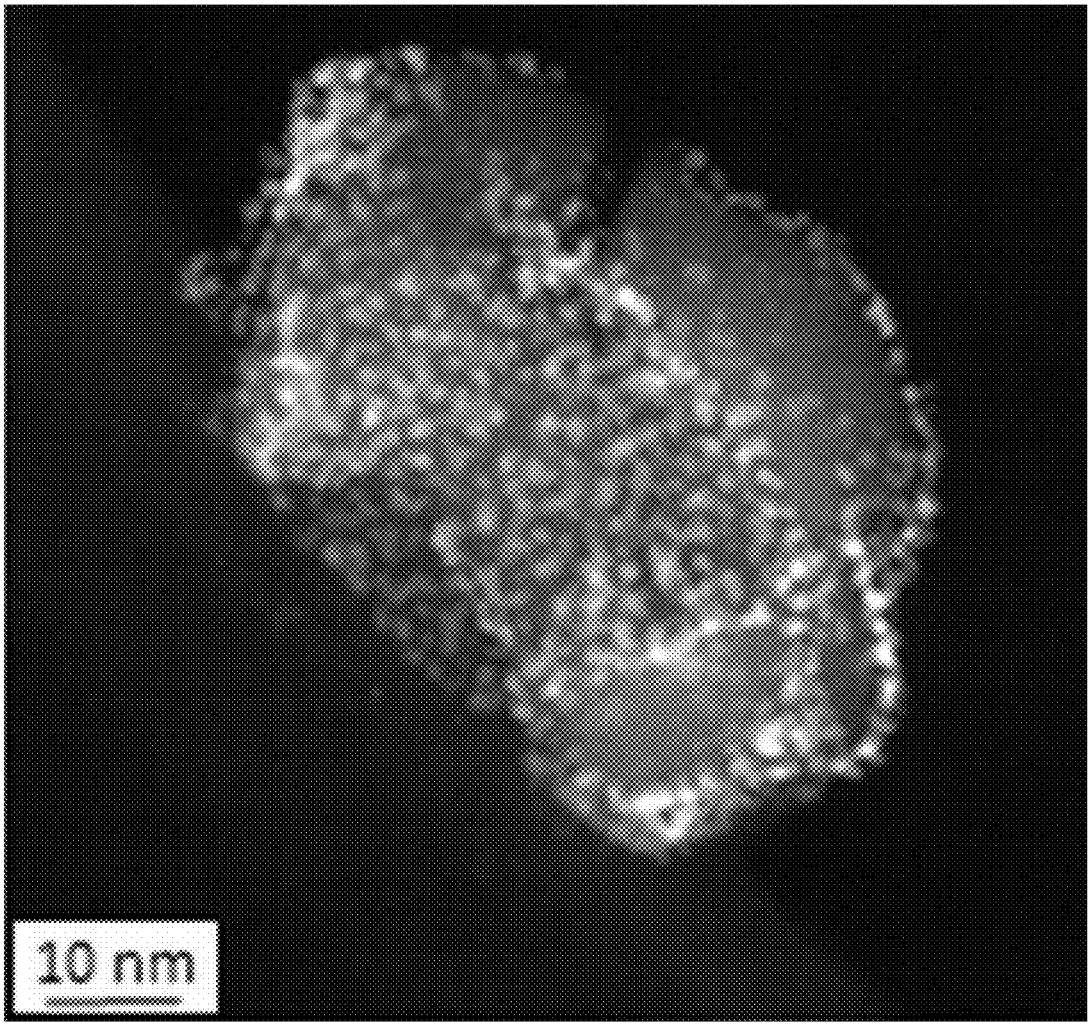
FIG. 3 is a magnified image, obtained with an HAADF-STEM, of an anode catalyst obtained pursuant to Example 1.

To create a uniform dispersion of iridium oxide catalyst particles on tungsten-doped titanium oxide support particles, first 2.57 g NaOH pellets were dissolved in 320 mL of warm ethylene glycol. Next, 1.00 g of tungsten-doped titanium nanoparticles (10-20 nm in diameter) were dispersed using 5 W of ultrasonication for 45 minutes. After ultrasonication, 1.18 g of iridium trichloride (1-2 nm in diameter) was then added to the reaction mixture, which was then heated to 175° C. for 3 hours under heavy stirring. The solution was then allowed to cool and poured into 2.0 L of deionized water. Nitric acid was added to the cooled reaction mixture until a pH of 1 was obtained. The reaction mixture was vacuum filtered, rinsed with water, and vacuum dried at 115° C. for 4 hours. The sample was then exposed to air at a temperature of less than 40° C. to form a surface oxide. The final product was approximately 36% iridium by mass as determined by XRF. FIG. 3 is an HAADF-STEM image of uniformly-dispersed iridium oxide particles illuminated against the darker backdrop of the tungsten-doped titanium oxide particles.

EXAMPLE 2

Chain-Linked Catalyst Particles on Catalyst Support Particles

Figure 4:
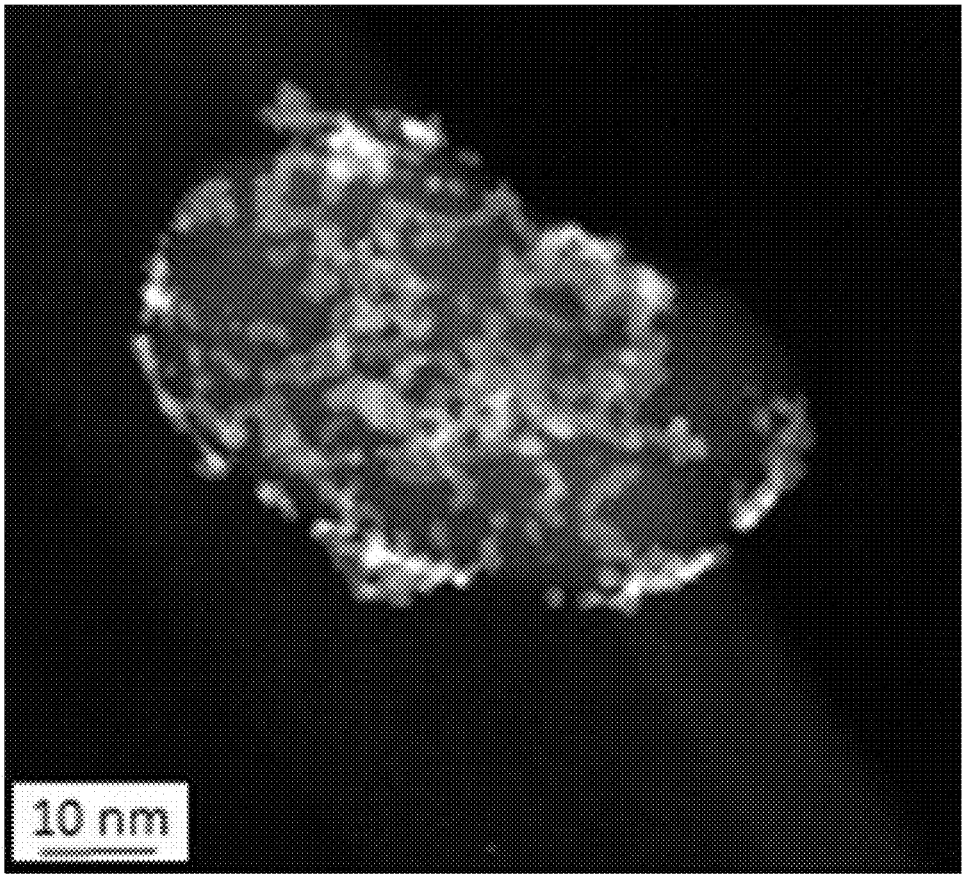
FIG. 4 is a magnified image, obtained with an HAADF-STEM, of an anode catalyst obtained pursuant to Example 2.

To create a chain-linked iridium oxide catalyst particles on tungsten-doped titanium oxide support particles, first 2.57 g NaOH pellets were dissolved in 320 mL of warm ethylene glycol. Next, 1.0 g of tungsten-doped titanium nanoparticles (10-20 nm in diameter) were dispersed using 5 W of ultrasonication for 45 minutes. Following ultrasonication, 2.3 g of iridium trichloride (1-2 nm in diameter) was then added to the reaction mixture over a mixing period of two hours. Once the mixing period was complete, the reaction mixture was then heated to 165° C. and slowly stirred for 3 hours. The reaction mixture was then cooled and poured into 2.0 L of deionized water. Nitric acid was added until a pH of 1 was obtained. The reaction mixture was vacuum filtered, rinsed with water, and vacuum dried at 115° C. for 4 hours. The sample was then exposed to air at a temperature of less than 40° C. to form a surface oxide. The final product was approximately 36% iridium by mass as determined by XRF. FIG. 4 is an HAADF-STEM image of chain-linked iridium oxide particles illuminated against the darker backdrop of the tungsten-doped titanium oxide particles.

EXAMPLE 3

Figure 5:
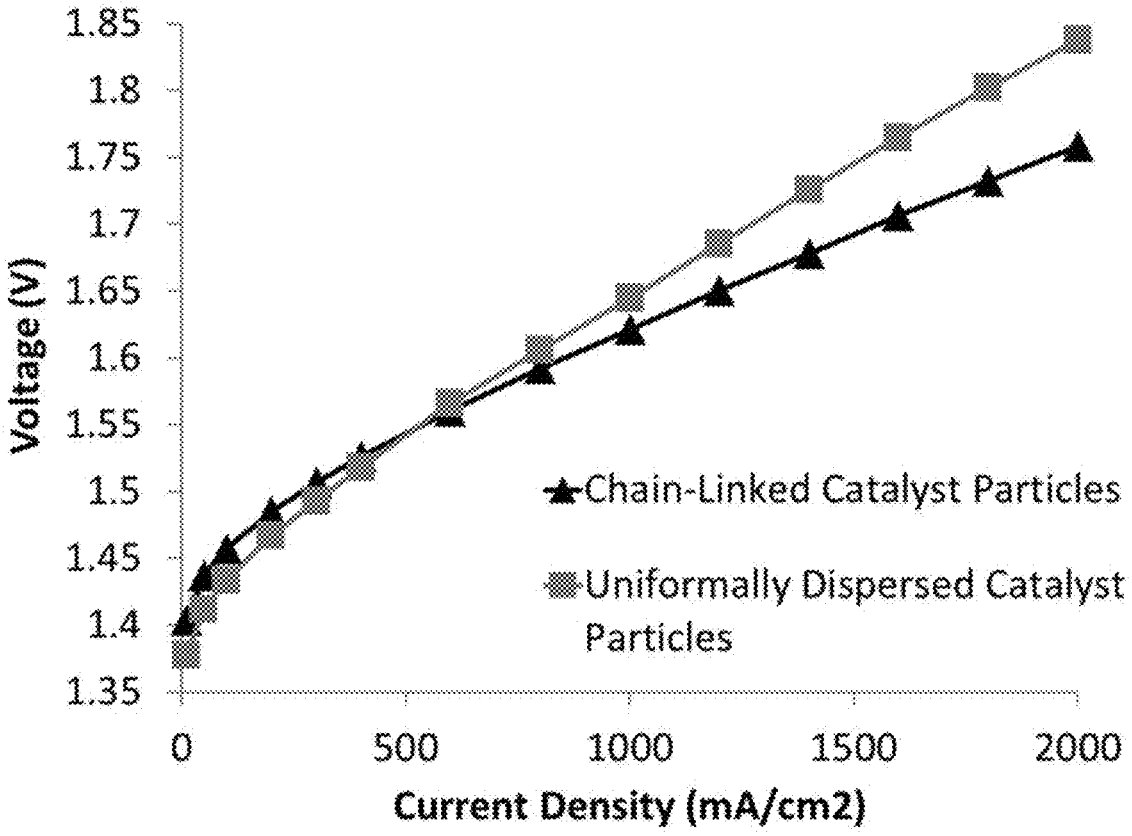
FIG. 5 is a graph depicting polarization curves obtained pursuant to Example 3.

The Performance of Uniformly-Dispersed Catalyst Particles vs. Chain-Linked Catalyst Particles on Catalyst Support Particles The uniformly-dispersed catalyst particles (deposited on catalyst support particles) fabricated in Example 1 and the chain-linked catalyst particles (deposited on catalyst support particles) in Example 2 were then each used as the anode catalyst layer in separate PEM-based water electrolyzer cells. The two PEM-based electrolyzer cells were then polarized at a range of current densities from 0-2000 $mA/cm^2$, and the voltage was measured at each current density. FIG. 5 shows the resulting polarization curves for the uniformly-dispersed particles (squares) and the chain-linked catalyst particles (triangles).

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An anode catalyst for a water electrolyzer, the anode catalyst consisting of:

(a) a support, wherein the support has a surface and wherein the support consists of at least one tungsten-doped titanium oxide; and (b) a plurality of inter-connected Ir particles aggregations deposited on the surface of the support, wherein all of the particles aggregations consist of iridium particles, wherein the particles aggregations are arranged to form one or more aggregations of catalyst particles, wherein each of the aggregations of catalyst particles consists of at least 10 catalyst particles, wherein each of the at least 10 catalyst particles of each of the aggregations is in physical contact with at least one other catalyst particle, wherein each particles aggregation has at least 10 Ir particles of a diameter of 0.5-5.0 nanometers and wherein each of the aggregations of catalyst particles consists of at least one of an unbranched chain or a branched chain.

2. The anode catalyst as claimed in claim 1 wherein the support consists of at least one catalyst aggregation.

3. The anode catalyst as claimed in claim 2 wherein the support consists of a plurality of catalyst aggregations.

4. The anode catalyst as claimed in claim 1 wherein the support consists of catalyst aggregations in the range of about 5 nanometers to about 2 microns.

5. The anode catalyst as claimed in claim 1 wherein the support consists of at least one catalyst aggregation and wherein the catalyst aggregations cover the circumference of the support.

6. The anode catalyst aggregations as claimed in claim 1 wherein the support has an open surface area in the range of about 20-80%.

7. An anode catalyst for a water electrolyzer, the anode catalyst consisting of:

(a) a support, wherein the support consists of a plurality of support particles and wherein each support particle has a surface and each support particle consists of at least one tungsten-doped titanium oxide; and (b) a plurality of inter-connected Ir particle aggregations deposited on the surface of the support, wherein all of the particles aggregations consist of iridium particles, wherein the particles aggregations are arranged to form one or more aggregations of catalyst particles, wherein each of the aggregations of catalyst particles consists of at least 10 catalyst particles, wherein each of the at least 10 catalyst particles of each of the aggregations is in physical contact with at least one other catalyst particle, wherein each particles aggregation has at least 10 Ir particles of a diameter of 0.5-5.0 nanometers and wherein each of the aggregations of catalyst particles consists of at least one of an unbranched chain or a branched chain; and (c) a binder, the support particles being dispersed in the binder.

8. A water electrolyzer cell comprising:

(a) a solid polymer proton exchange membrane, the solid polymer proton exchange membrane having first and second opposed faces;

an anode catalyst layer, the anode catalyst layer being positioned along the first face of the solid polymer proton exchange membrane, said anode catalyst layer consisting of (i) a support, the support having a surface, (ii) a plurality of catalyst particle aggregations deposited on the surface of the support, and (iii) a binder, the support particles being dispersed in the binder, wherein all of the particles aggregations consist of iridium particles, wherein the catalyst particles aggregations are arranged to form one or more aggregations of particles, wherein each of the aggregations of catalyst particles consists of at least 10 catalyst particles, wherein each of the at least 10 catalyst particles of each of the aggregations is in physical contact with at least one other catalyst particle, wherein each particles aggregation has at least 10 Ir particles of a diameter of 0.5-5.0 nanometers and wherein each particles aggregations consists of at least one of an unbranched chain or a branched chain;

(c) a cathode catalyst layer, the cathode catalyst layer being positioned along the second face of the solid polymer proton exchange membrane;

(d) a first current collector, the first current collector being positioned along the anode catalyst layer opposite the solid polymer exchange membrane; and (e) a second current collector, the second current collector being positioned along the cathode catalyst layer opposite the solid polymer exchange membrane.

9. The water electrolyzer cell as claimed in claim 8 wherein said support consists of a plurality of catalyst aggregations having a diameter in the range of about 5 nanometers to about 2 microns.

10. The water electrolyzer cell as claimed in claim 8 wherein the support consists of at least one of a metal oxide and a doped metal oxide.

11. The water electrolyzer cell as claimed in claim 10 wherein the metal oxide consists of at least one member selected from the group consisting of titanium oxide, zirconium oxide, niobium oxide, tantalum oxide, and tin oxide.

12. The water electrolyzer cell as claimed in claim 11 wherein the doped metal oxide consists of a dopant that is at least one member selected from the group consisting of tungsten, molybdenum, niobium, and fluorine.

13. The water electrolyzer cell as claimed in claim 8 wherein the support consists of tungsten-doped titanium oxide particle.

14. An anode catalyst for a water electrolyzer, the anode catalyst consisting of:

(a) a support, the support having a surface; and a plurality of inter-connected Ir particle aggregations deposited on the surface of the support, wherein all of the particles aggregations consist of iridium particles, wherein the particles aggregations are arranged to form one or more aggregations of catalyst particles, wherein each of the aggregations of catalyst particles consists of at least 10 catalyst particles, wherein each of the at least 10 catalyst particles of each of the aggregations is in physical contact with at least one other catalyst particle, wherein each particles aggregation has at least 10 Ir particles of a diameter of 0.5-5.0 nanometers and wherein each of the aggregations of catalyst particles consists of at least one of an unbranched chain or a branched chain.

15. The anode catalyst aggregations as claimed in claim 1 wherein the support has an open surface area of about 80%.

16. The water electrolyzer cell as claimed in claim 8 wherein the support has an open surface area of about 80%.

17. The anode catalyst as claimed in claim 14 wherein the support has an open surface area of about 80%.

* * * * *